US011519646B2

(12) United States Patent
Zou

(10) Patent No.: US 11,519,646 B2
(45) Date of Patent: Dec. 6, 2022

(54) HEAT PUMP SYSTEMS WITH GAS BYPASS AND METHODS THEREOF

(71) Applicant: Rheem Manufacturing Company, Atlanta, GA (US)

(72) Inventor: Yang Zou, Dallas, TX (US)

(73) Assignee: RHEEM MANUFACTURING COMPANY, Atlanta, GA (US)

( * ) Notice: Subject to any disclaimer, the term of this patent is extended or adjusted under 35 U.S.C. 154(b) by 194 days.

(21) Appl. No.: 17/005,418

(22) Filed: Aug. 28, 2020

(65) Prior Publication Data

US 2022/0065504 A1 Mar. 3, 2022

(51) Int. Cl.
*F25B 41/26* (2021.01)
*F25B 39/00* (2006.01)
(Continued)

(52) U.S. Cl.
CPC ..... *F25B 41/26* (2021.01); *F25B 13/00* (2013.01); *F25B 39/00* (2013.01); *F25B 41/31* (2021.01);
(Continued)

(58) Field of Classification Search
CPC ..... F25B 41/26; F25B 41/31; F25B 13/00; F25B 39/00; F25B 49/02;
(Continued)

(56) References Cited

U.S. PATENT DOCUMENTS 10,323,863 B2 * 6/2019 Siegert ..... F25B 1/10
2010/0181062 A1 * 7/2010 McCann ..... F28C 1/04 165/185
2011/0197607 A1 * 8/2011 Tanaka ..... F24F 11/83 62/180

FOREIGN PATENT DOCUMENTS

CN 20297369 * 1/2006
CN 202973694 U 6/2013
FR 3089604 A1 6/2020

OTHER PUBLICATIONS

Tuo, H., 2014. Flash gas bypass—a way to improve distribution of adiabatic two-phase refrigerant flow in headers of microchannel evaporators. Ph.D. thesis of Univ. of Illinois at Urbana-Champaign, 204 pages.

(Continued)

*Primary Examiner* — Henry T Crenshaw
(74) *Attorney, Agent, or Firm* — Eversheds Sutherland (US) LLP

(57) ABSTRACT

Heat pump systems with a gas bypass tank and that operate in both heating and cooling modes are disclosed. The systems include a first splitting valve that can route liquid refrigerant to either the indoor coil or the outdoor coil, depending on whether the heat pump system is in heating or cooling mode. An expansion valve in the system can lower the pressure of liquid refrigerant leaving a condenser, thereby creating a two-phase fluid comprising liquid refrigerant and vaporized refrigerant. The gas bypass tank can separate liquid refrigerant from vaporized refrigerant. The liquid refrigerant can be supplied to the evaporator of the system, while the vaporized refrigerant can be bypassed to a compressor. The first splitting valve can include a first plurality of switching paths that route the separated liquid refrigerant to either the outdoor coil or the indoor coil.

16 Claims, 10 Drawing Sheets

(51) Int. Cl.
*F25B 49/02* (2006.01)
*F25B 13/00* (2006.01)
*F25B 41/31* (2021.01)

(52) U.S. Cl.
CPC ..... *F25B 49/02* (2013.01); *F25B 2313/0292* (2013.01); *F25B 2400/04* (2013.01); *F25B 2600/2501* (2013.01); *F25B 2600/2515* (2013.01)

(58) Field of Classification Search
CPC ..... F25B 2313/0292; F25B 2400/04; F25B 2600/2501; F25B 2600/2515
See application file for complete search history.

(56) References Cited

OTHER PUBLICATIONS

Milosevic, A., 2011. Flash gas bypass concept utilizing low pressure refrigerants. M.S. thesis of Univ. of Illinois at Urbana-Champaign, 316 pages.
Beaver, A.E., et al., 1999. An experimental investigation of transcritical carbon dioxide systems for residential air-conditioning. ACRC Report CR-18, Univ. of Illinois at Urbana-Champaign, 138 pages.
Elbel, S. and Hrnjak, P.S., 2004. Flash gas bypass for improving the performance of transcritical R744 systems that use microchannel evaporators. Int. J. Refrigeration. 27(7), 724-735.
International Search Report and Written Opinion for PCT Application No. PCT/US2021/047282 dated Nov. 11, 2021.

* cited by examiner

HEAT PUMP SYSTEMS WITH GAS BYPASS AND METHODS THEREOF

FIELD OF THE DISCLOSURE

Examples of the present disclosure relate generally to heat pump systems and, more specifically, to heat pump systems having a gas bypass tank and that operate in both heating and cooling modes.

BACKGROUND

Heat pump systems based on a vapor compression cycle typically include an expansion device, such as an expansion valve, to reduce the pressure of refrigerant before the refrigerant is supplied to an evaporator. The reduction in pressure aims to liquify the refrigerant before it enters the evaporator, since liquid refrigerant has higher heat transfer properties, lower pressure drop, and better distribution within the evaporator. Expansion devices are not 100% efficient, however, meaning the refrigerant entering the evaporator in many systems is not fully liquified. Instead, the refrigerant flow into the evaporator is a two-phase fluid, including both vaporized refrigerant and liquified refrigerant.

Attempts have been made to reduce the pressure drop in the evaporator by isolating liquid refrigerant before the refrigerant is sent to the evaporator. However, prior methods do not provide solutions for heat pump systems that are capable of switching between heating and cooling modes. What is needed, therefore, are systems and methods that separate the liquid refrigerant from the vapor refrigerant, such that only liquid refrigerant is supplied to the evaporator. Preferably, the systems and methods can provide these solutions in heat pump systems that are capable of reversing refrigerant direction flow, for example when an indoor coil system and an outdoor coil system act as both a condenser and evaporator, depending on whether the heat pump system is in heating mode or cooling mode.

BRIEF SUMMARY

The present disclosure provides a heat pump system switchable between a heating mode and a cooling mode. The system can include an outdoor coil that can operate as an evaporator when the heat pump system is in the heating mode and can operate as a condenser when the heat pump system is in the cooling mode. The system can include an indoor coil that can operate as the evaporator when the heat pump system is in the cooling mode and can operate as the condenser when the heat pump system is in the heating mode. The system can include a gas bypass tank having a liquid outlet, a vapor outlet, and a bypass inlet. The bypass inlet can receive two-phase refrigerant from an expansion valve. The system can include a first splitting valve that can reverse direction of refrigerant to direct refrigerant to the gas bypass tank. The first splitting valve can include a first splitter inlet in fluid communication with the liquid outlet of the gas bypass tank. The first splitter inlet can receive liquid refrigerant from the gas bypass. The first splitting valve can include a first plurality of switching paths configured to route the liquid refrigerant to one of the outdoor coil or the indoor coil. The first splitting valve can route the liquid refrigerant to the indoor coil when the heat pump system is in the cooling mode, and the first splitting valve can route the liquid refrigerant to the outdoor coil when the heat pump system is in the heating mode.

The heat pump system can also include a compressor having a compressor inlet and a compressor outlet. The compressor inlet can be in fluid communication with the vapor outlet of the gas bypass tank. The compressor outlet can provide vaporized refrigerant to whichever coil is acting as the condenser of the system. A second splitting valve can route the vaporized refrigerant into and out of the compressor. A second splitter inlet of the second splitting valve can be in communication with the compressor outlet. The second splitting valve can include a second plurality of switching paths configured to route the vaporized refrigerant to one of the outdoor coil or the indoor coil. The vaporized refrigerant can be routed by the second splitting valve to the outdoor coil when the heat pump system is in the cooling mode, and the vaporized refrigerant can be routed by the second splitting valve to the indoor coil when the heat pump system is in the heating mode.

When the heat pump system is in the cooling mode, the second plurality of switching paths can route low pressure vapor from the indoor coil into the compressor inlet. When the heat pump system is in the heating mode, the second plurality of switching paths can route low pressure vapor from the outdoor coil into the compressor inlet. The first splitting valve can be a rotating ball valve, and the second splitting valve can be a solenoid valve, or vice versa.

The gas bypass tanks described herein can include various designs to ensure low pressure vapor is supplied to the compressor and low pressure liquid is provided to the evaporator. For example, some designs include inclining the bypass inlet to avoid splashing of the two-phase refrigerant leaving the expansion valve. Other designs include changing the cross section geometry of the gas bypass tank so as to avoid splashing. These cross sectional geometries can include elliptical, rectangular, and other non-circular geometries.

Another aspect of the present disclosure provides a heating and cooling system. The system can include a gas bypass tank having a bypass inlet, a liquid outlet, and a vapor outlet. The bypass inlet can receive two-phase refrigerant (i.e., vapor and liquid) from an expansion valve. The system can also include a first splitting valve. The first splitting valve can include a first splitter outlet in fluid communication with the bypass inlet. The first splitting valve can include a first splitter inlet in fluid communication with the liquid outlet of the gas bypass tank. The first splitting valve can include a first plurality of switching paths switchable from a first conduit path in fluid communication with a first coil system to a second conduit path in fluid communication with a second coil system. The first coil system can be an outdoor coil, and the second coil system can be an indoor coil.

The system can include a compressor. The compressor can include a compressor inlet in fluid communication with the vapor outlet of the gas bypass tank. The compressor can include a compressor outlet configured to provide vaporized refrigerant. The system can further include a second splitting valve. The second splitting valve can include a second splitter inlet in communication with the compressor outlet. The second splitting valve can include a second plurality of switching paths configured to route the vaporized refrigerant to the first coiled system or the second coiled system.

When the heating and cooling system is in a cooling mode, the second plurality of switching paths can route low pressure vapor from the indoor coil into the compressor inlet. When the heating and cooling system is in a heating mode, the second plurality of switching paths can route low pressure vapor from the outdoor coil into the compressor inlet.

These and other aspects of the present disclosure are described in the Detailed Description below and the accompanying figures. Other aspects and features of the present disclosure will become apparent to those of ordinary skill in the art upon reviewing the following description of specific examples of the present disclosure in concert with the figures. While features of the present disclosure may be discussed relative to certain examples and figures, all examples of the present disclosure can include one or more of the features discussed herein. Further, while one or more examples may be discussed as having certain advantageous features, one or more of such features may also be used with the various other examples of the disclosure discussed herein. In similar fashion, while examples may be discussed below as devices, systems, or methods, it is to be understood that such examples can be implemented in various devices, systems, and methods of the present disclosure.

BRIEF DESCRIPTION OF THE DRAWINGS

The accompanying drawings, which are incorporated in and constitute a part of this specification, illustrate multiple examples of the presently disclosed subject matter and serve to explain the principles of the presently disclosed subject matter. The drawings are not intended to limit the scope of the presently disclosed subject matter in any manner. In the drawings.

DETAILED DESCRIPTION

Heat pump systems rely on the phase changes of refrigerant in the system to either absorb heat (i.e., at an evaporator) or release heat (i.e., at a condenser). Ordinarily, an expansion valve is placed in the heat pump system between a coil system acting as a condenser and a coil acting as an evaporator. The expansion valve aims to decrease the pressure of the high pressure, liquid refrigerant leaving the condenser so as to provide low pressure, low temperature liquid refrigerant to the evaporator. This is because the low pressure liquid refrigerant has greater heat transfer properties, lower pressure drop, and better refrigerant distribution through the evaporator. However, expansion valves typically do not operate at 100% efficiency. To this end, in prior systems the refrigerant entering the evaporator is a two-phase fluid comprising both liquid and vaporized refrigerant, thereby decreasing the effectiveness of the heat absorption at the evaporator.

Innovations have aimed at providing only liquid refrigerant to the evaporator. However, prior attempts did not contemplate or provide solutions for systems that act both as an air condition unit and a heating unit. For example, in many commercial and residential Heating Ventilation and Air Conditioning (HVAC) systems, the system is reversible, meaning a set of coils (i.e., an outdoor coil) can act as a condenser in cooling mode and act as an evaporator in heating mode, while a second set of coils (i.e., an indoor coil) can act as an evaporator in cooling mode and act as a condenser in heating mode. The need to switch directions of refrigerant flow in these systems creates added complexity when attempting to separate and provide only liquid refrigerant to the evaporator(s).

The present systems and methods provide solutions to the limitations of prior designs by ensuring liquid refrigerant is passed to the evaporator, while also ensuring vaporized refrigerant bypasses the evaporator and continues to a compressor inlet, regardless of which direction the refrigerant is flowing (i.e., cooling mode versus heating mode). Various systems and methods are disclosed for heat pump systems with a gas bypass tank that operate in both heating and cooling modes, and example systems will now be described with reference to the accompanying figures.

Figure 1:
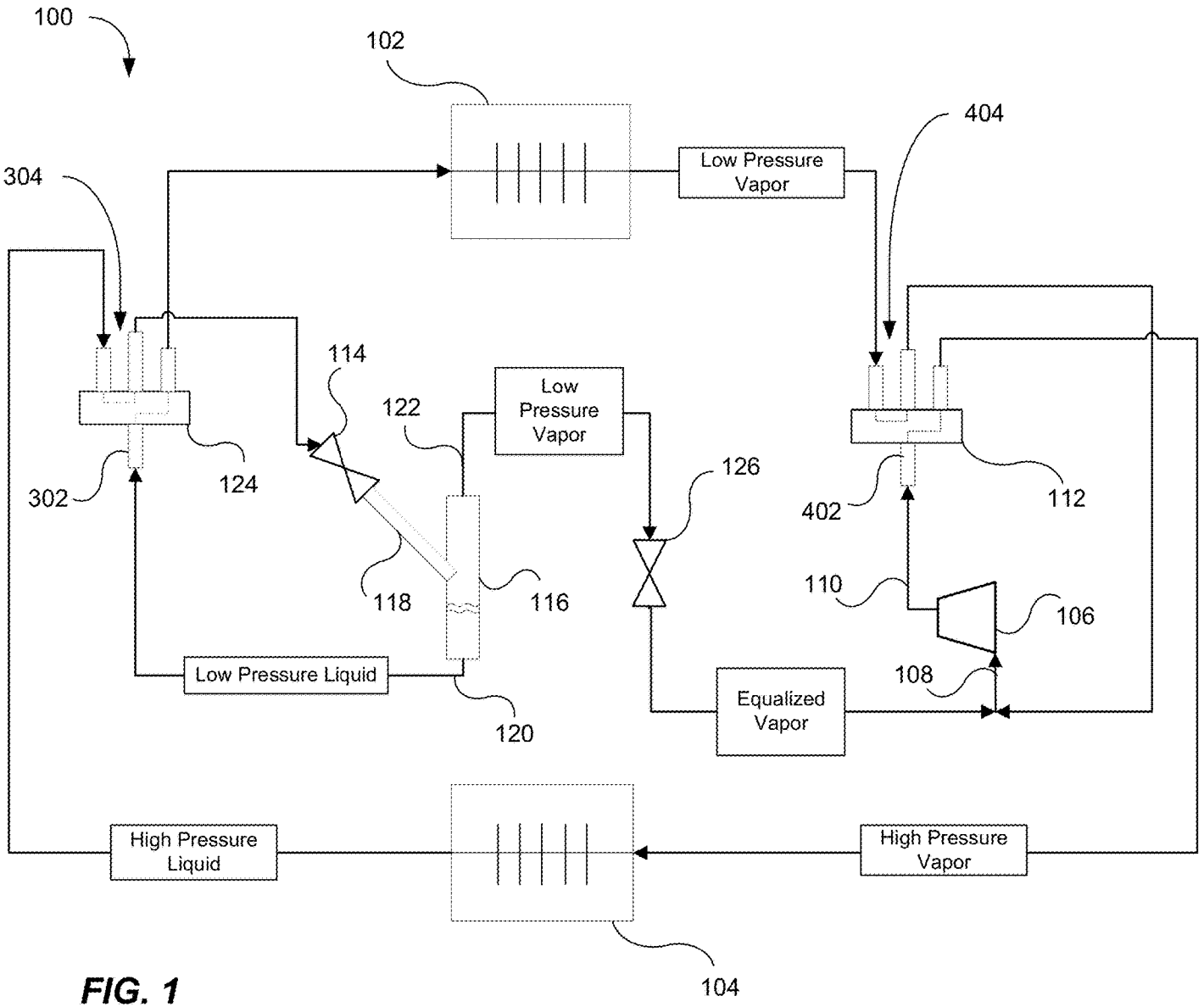
FIG. 1 is a schematic of an example heat pump system in a heating mode, in accordance with the present disclosure.

FIG. 1 is a schematic of an example heat pump system 100 in a heating mode. The heat pump system 100 can include an outdoor coil 102, an indoor coil 104, and a compressor 106. In the heating mode, the outdoor coil 102 can act as an evaporator for the heat pump system 100, and the indoor coil 104 can act as a condenser. Low pressure vapor can exit the outdoor coil 102 evaporator, can continue to a compressor inlet 108, and can be compressed into high pressure vapor by the compressor 106. High pressure vapor exits the compressor 106 at a compressor outlet 110 and continues to the indoor coil 104 (which is acting as a condenser), and high-pressure liquid can exit the indoor coil 104. As will be described in greater with reference to FIG. 2, this flow path can be reversed by a splitting valve 112 (located between the outdoor coil 102 and the compressor 106 and between the compressor 106 and the indoor coil 104) when the system is switched to a cooling mode.

After the high pressure liquid exits the indoor coil 104, the refrigerant can enter an expansion valve 114 that acts to lower the pressure of the refrigerant to a low temperature mixture of liquid and vapor refrigerant. The lower pressure liquid refrigerant enables a greater degree of expansion in the evaporator (i.e., outdoor coil 102 while in heating mode). As described above, the refrigerant is not ordinarily fully liquified by the expansion valve 114, and a two-phase liquid/vapor fluid can be present after refrigerant leaves the expansion valve 114. Because the evaporator performance can be improved if only liquid refrigerant is present (since liquid has higher heat transfer properties, lower pressure drop, and better refrigerant distribution), the present heat pump systems 100 can include a gas bypass tank 116 positioned after the expansion valve 114 to separate the vapor from the liquid. The two-phase refrigerant can enter the gas bypass tank 116 via a bypass inlet 118. Within the gas bypass tank 116, the liquid refrigerant can, via gravity, sink to a first end of the gas bypass tank 116, while the vaporized refrigerant can exit a second end of the gas bypass tank 116. A liquid outlet 120 positioned at the first end of the gas bypass tank 116 can route the low pressure liquid to the evaporator (i.e., the outdoor coil 102 in heating mode), and a vapor outlet 122 positioned at the second end of the gas bypass tank 116 can route the low pressure vapor to the compressor 106 (i.e., the compressor inlet 108).

The indoor coil 104 and the outdoor coil 102 can include a variety of different coil designs. For example, the indoor coil 104 and/or the outdoor coil 102 can be a microchannel, tube-fin, tube (including micro-tube and mini-tube evaporators), roll bond, and/or similar coil designs. The expansion valve 114 described above can be a thermal expansion valve (TXV) or electronic expansion valve (EEV). Furthermore, the heat pump system 100 can be incorporated into packaged, ducted split or ductless split, and/or similar heat pump systems.

As described above, the present heat pump systems 100 provide solutions for systems that operate in both heating and cooling mode. To ensure that liquid refrigerant from the expansion valve 114 is routed to the evaporator in either mode, and to ensure that vaporized refrigerant from the expansion valve 114 is routed to the compressor 106 in either mode, the system can utilize a splitting valve 124 positioned prior to the expansion valve 114 (i.e., the splitting valve 124 can be located downstream of the coil currently acting as the condenser and upstream of the expansion valve 114). For simplicity and clarity, the splitting valve 112 described above that is positioned in series after the compressor outlet 110 will be referred to as a "second splitting valve," and the splitting valve 124 that is positioned in series before the expansion valve 114 will be referred to as a "first splitting valve." The first splitting valve 124 can receive high pressure liquid from the coil acting as a condenser (i.e., indoor coil when in heating mode, outdoor coil when in cooling mode), route the high pressure liquid to the expansion valve 114, and route the low pressure liquid from the gas bypass tank 116 (i.e., the liquid from the liquid outlet 120), to the coil acting as the evaporator (i.e., outdoor coil when in heating mode, indoor coil when in cooling mode). To illustrate this reversing of condenser output and evaporator input, reference can be made to the flow of refrigerant while the heat pump system 100 is in cooling mode, as shown in FIG. 2.

Figure 2:
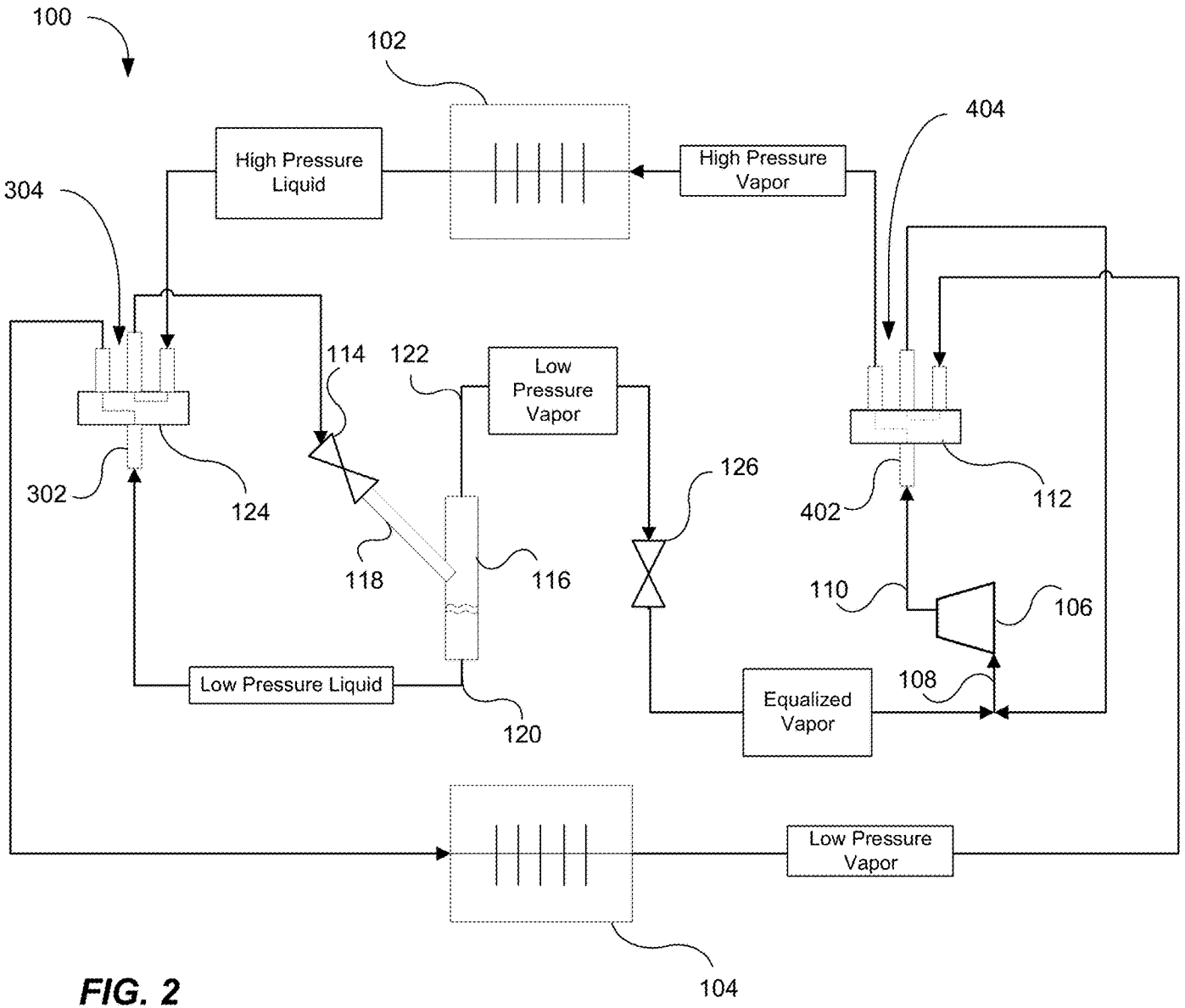
FIG. 2 is a schematic of an example heat pump system in a cooling mode, in accordance with the present disclosure.

FIG. 2 is a schematic of an example heat pump system 100 in a cooling mode. In cooling mode, the outdoor coil 102 can act as a condenser for the heat pump system 100, and the indoor coil 104 can act as an evaporator. Low pressure vapor can exit the indoor coil 104, can continue to a compressor inlet 108 via the second splitting valve 112, and can be compressed into high pressure vapor by the compressor 106. High pressure vapor exits the compressor 106 at the compressor outlet 110 and continues to the outdoor coil 102 (which is acting as the condenser), and high-pressure liquid can exit the outdoor coil 102. As can be seen, the second splitting valve 112 has reversed the flow of the refrigerant in this mode, causing the high pressure vapor coming from the compressor 106 to enter the outdoor coil 102 instead of the indoor coil 104, as was the case in heating mode.

After the high pressure liquid exits the outdoor coil 102, the refrigerant enters the expansion valve 114 via the first splitting valve 124, and the two-phase fluid that exits the expansion valve 114 is separated by the gas bypass tank 116. The low-pressure, vaporized refrigerant exits the vapor outlet 122 and is bypassed to the compressor inlet 108, and the low-pressure, liquified refrigerant is routed to the first splitting valve 124. The first splitting valve 124 then routes the liquified refrigerant to the indoor coil 104. As can be seen, the first splitting valve 124 can reverse the flow of the refrigerant in this mode, causing the low pressure liquid coming from gas bypass tank 116 to enter the indoor coil 104 instead of the outdoor coil 102, as was the case in heating mode.

As described above, the low pressure vapor that exits the vapor outlet 122 of the gas bypass tank 116 can be routed to the compressor inlet 108. In either heating (i.e., FIG. 1) or cooling (i.e., FIG. 2) mode, the low pressure vapor from the gas bypass tank 116 can join with low pressure vapor from the coil currently acting as the evaporator, depending on the mode. For example, the low pressure vapor from the gas bypass tank 116 can join with low pressure vapor from the indoor coil 104 when in cooling mode or from the outdoor coil 102 when in heating mode. Optionally, it can be beneficial to equalize the pressure between the low pressure vapor from the evaporator and the low pressure vapor from the gas bypass tank 116. If the vapor pressure is significantly different between the two paths when they join, it can cause a pressure backup in the evaporator or the gas bypass tank 116. To correct for a potential pressure differential, an equalization valve 126 can be positioned between the compressor inlet 108 and the vapor outlet 122.

The heat pump systems 100 described herein can utilize two sets of switching valves (i.e., first splitting valve 124 and second splitting valve 112) to route refrigerant to the respective components. For example, the first splitting valve 124 can adjust flow of the low pressure liquid from the gas bypass tank 116 to either the outdoor coil 102 or the indoor coil 104; the second splitting valve can adjust flow of the high pressure vapor from the compressor 106 to either the indoor coil 104 or the outdoor coil 102. To do so, the respective splitting valves can include inlets and a plurality of switching paths to switch refrigerant flow. For example, the first splitting valve 124 can include a first splitter inlet 302 and a first plurality of switching paths 304, which are described in greater detail with reference to FIGS. 3A-3D; and the second splitting valve 112 can include a second splitter inlet 402 and a second plurality of switching paths 404, which are described in greater detail with reference to FIGS. 4A-4B.

Figure 3B:
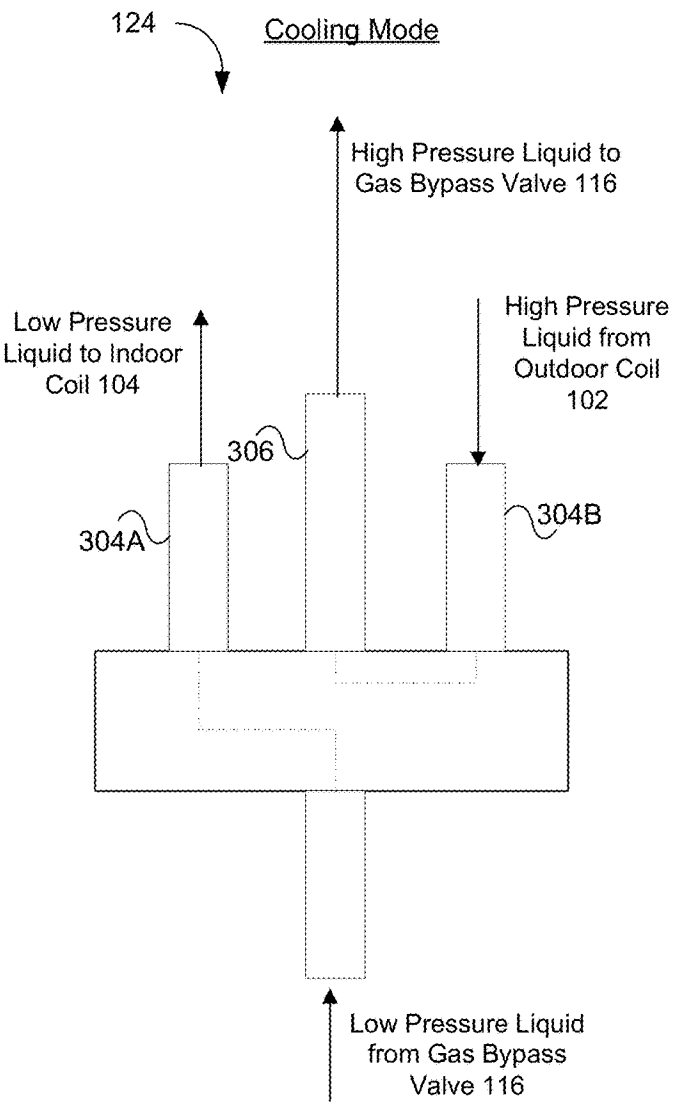
FIGS. 3A-3D depict example first splitting valves, in accordance with the present disclosure.
Figure 3A:
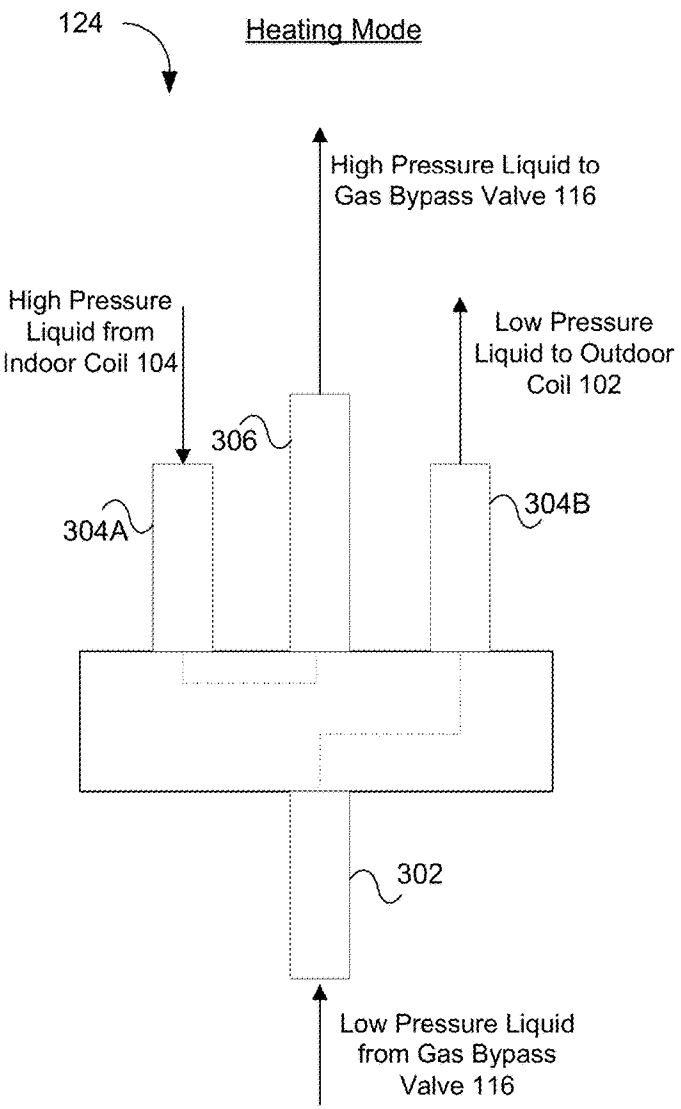

FIGS. 3A-3D depict example first splitting valves 124. Referring to FIGS. 3A and 3B, the example first splitting valves 124 illustrate how the refrigerant flow can be reversed between heating and cooling modes. The first splitting valve 124 can be considered a switch that enables the refrigerant flow to be routed to the appropriate coil system, depending on the mode. FIG. 3A depicts a first splitting valve 124 when the heat pump system 100 is in a heating mode. High pressure liquid from the condenser (which is the indoor coil 104 in heating mode) can be routed into a first path 304A and to a first splitter outlet 306. The first splitter outlet 306 can route the refrigerant to the gas bypass tank 116, and the low pressure liquid from the gas bypass tank 116 can then be re-routed to a first splitter inlet 302. The first splitting valve 124 can then route the low pressure liquid refrigerant from the first splitter inlet 302 to the evaporator (which is the outdoor coil 102 in heating mode) via a second path 304B.

To reverse the flow when the system is in cooling mode, the first plurality of switching paths 304 (which includes the first path 304A and the second path 304B), can switch directions, as depicted in FIG. 3B. FIG. 3B depicts a first splitting valve 124 when the heat pump system 100 is in a cooling mode. High pressure liquid from the condenser (which is the outdoor coil 102 in cooling mode) is routed into the second path 304B and to the first splitter outlet 306. The first splitter outlet 306 can route the refrigerant to the gas bypass tank 116, and the low pressure liquid from the gas bypass tank 116 can then be re-routed to the first splitter inlet 302. The first splitting valve 124 can then route the low pressure liquid refrigerant from the first splitter inlet 302 to the evaporator (which is the indoor coil 104 in cooling mode) via the first path 304A.

Figure 3D:
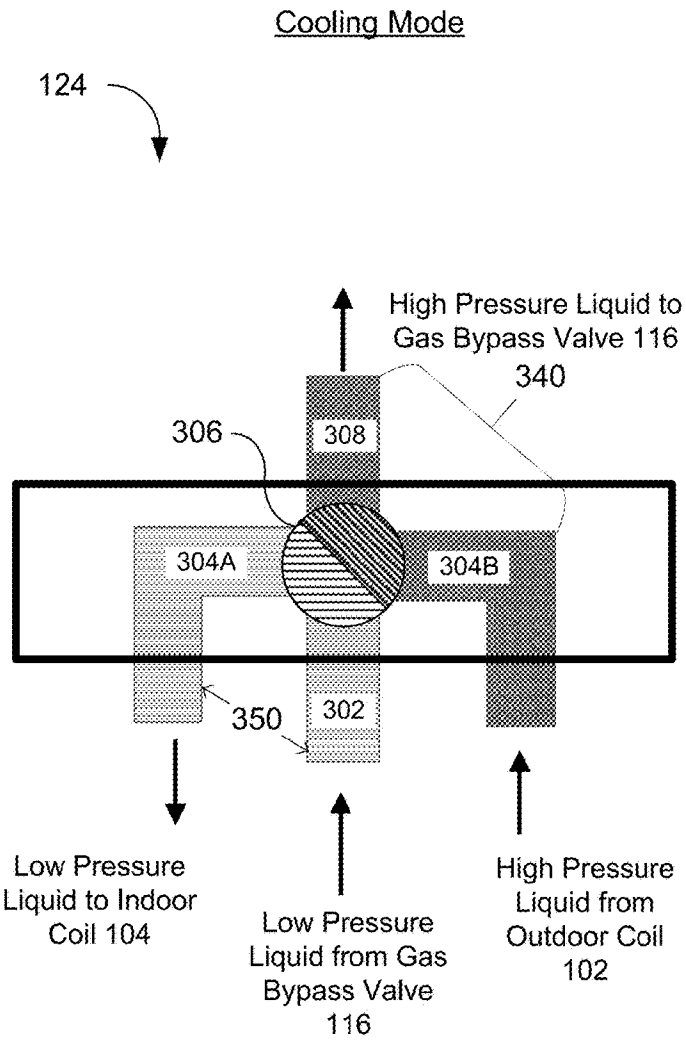
Figure 3C:
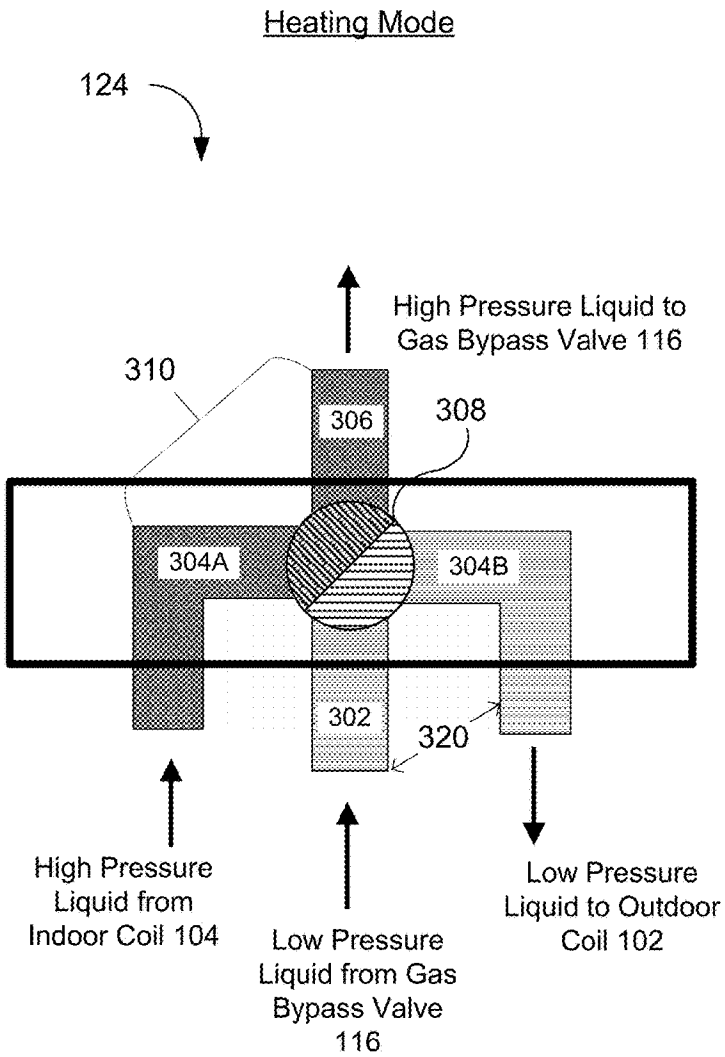

As can be seen from the above with respect to FIGS. 3A and 3B, the first splitting valve 124 can include a first splitter inlet 302 that always receives the low pressure liquid from the gas bypass tank 116, and can include a first splitter outlet 306 that always routes the high pressure liquid from to gas bypass tank 116. The remaining conduits (i.e., the first path 304A and the second path 304B) can switch based on the mode of the heat pump system 100. The switching of the valves can be completed by any number of reversing valve designs, including a solenoid valve and a reversing ball valve design. FIGS. 3C and 3D depict a reversing ball valve design. The reversing ball valve design can be beneficial for the first splitting valve 124, because the valve is positioned such that liquid refrigerant is flowing through the valve. To this end, the reversing ball valve design can help tolerate the high pressure, high density flow of liquid refrigerant over time, thus reducing the risk for leaking from high pressure liquid to low pressure liquid.

FIG. 3C depicts a first splitting valve 124 having a reversing ball valve design, wherein the heat pump system 100 is in a heating mode. The reversing ball valve design includes a rotating ball 308 that separates the flow path into two chambers. In heating mode, one chamber (e.g., first chamber 310) connects the indoor coil 104 to the bypass inlet 118 of the gas bypass tank 116, and the other chamber (e.g., second chamber 320) connects the liquid outlet 120 of the gas bypass tank 116 to the outdoor coil 102. When the mode is switched to the cooling mode, as shown in FIG. 3D, the ball 308 in the valve can rotate 90° such that one chamber (e.g., third chamber 340) connects the outdoor coil 102 to the bypass inlet 118 of the gas bypass tank 116, and the other chamber (e.g., fourth chamber 350) connects the liquid outlet 120 of the gas bypass tank 116 to the indoor coil 104.

Figure 4B:
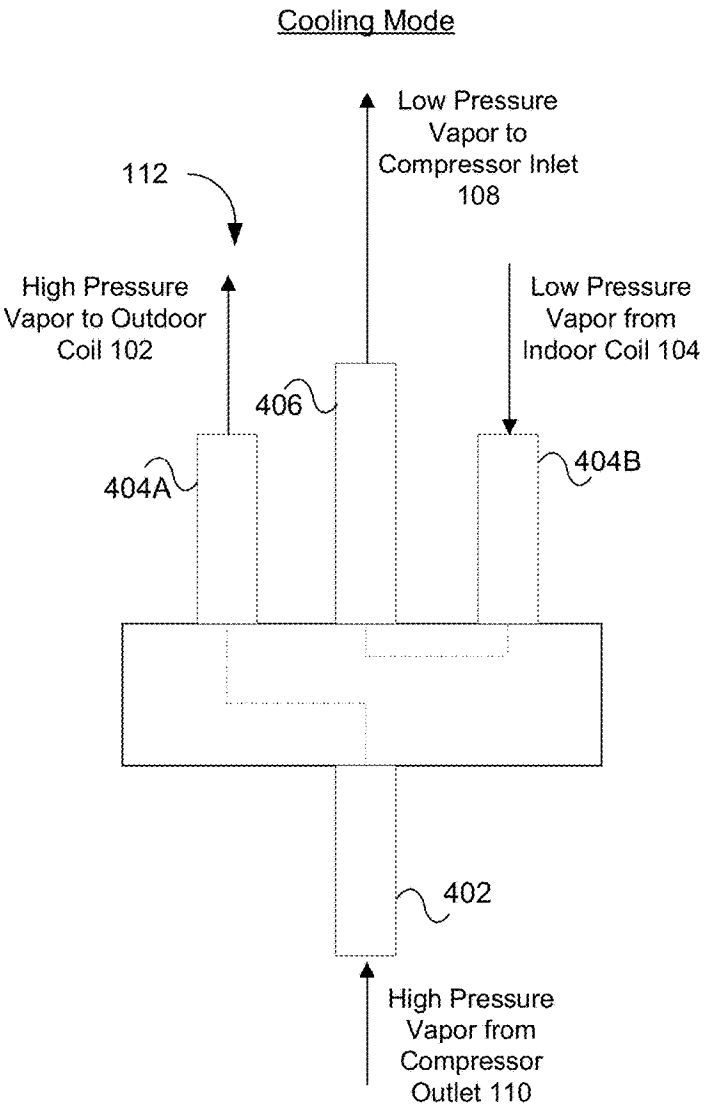
FIGS. 4A and 4B depict example second splitting valves, in accordance with the present disclosure.
Figure 4A:
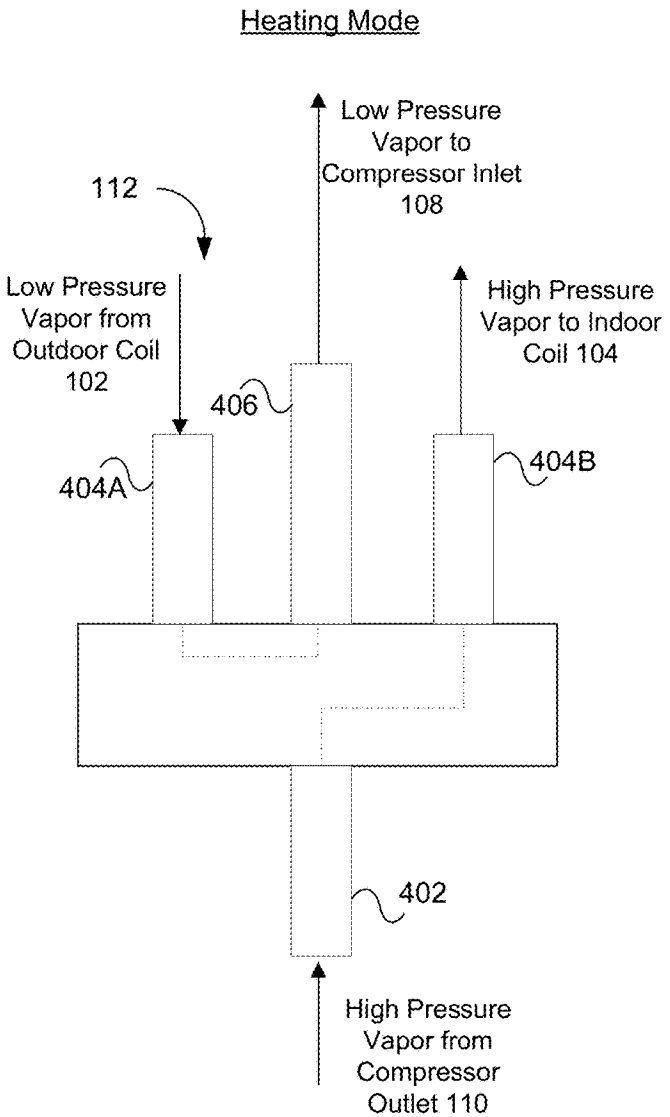

As described above, the heat pump system 100 can include a second splitting valve 112 that switches between heating and cooling mode such that the high pressure vapor created by the compressor 106 is provided to either the indoor coil 104 or the outdoor coil 102, depending on the mode. FIGS. 4A-4B depict example second splitting valves 112. FIG. 4A depicts a second splitting valve 112 when the heat pump system 100 is in a heating mode. High pressure vapor from the compressor outlet 110 can enter the second splitting valve 112 at a second splitter inlet 402. The second splitting valve 112 can then route the high pressure vapor to the indoor coil 104 (which acts as the condenser in heating mode) via a second path 404B. Low pressure vapor from the outdoor coil 102 (which acts as an evaporator in heating mode) can enter the second splitting valve 112 at a first path 404A. The second splitting valve 112 can then route the low pressure vapor to a compressor inlet 108 via a second splitter outlet 406.

To reverse the flow when the system is in cooling mode, the second plurality of switching paths 404 (which includes the first path 404A and the second path 404B), can switch directions, as depicted in FIG. 4B. FIG. 4B depicts a second splitting valve 112 when the heat pump system 100 is in a cooling mode. High pressure vapor from the compressor outlet 110 can enter the second splitting valve 112 at a second splitter inlet 402. The second splitting valve 112 can then route the high pressure vapor to the outdoor coil 102 (which acts as the condenser in cooling mode) via the first path 404A. Low pressure vapor from the indoor coil 104 (which acts as an evaporator in cooling mode) can enter the second splitting valve 112 at the second path 404B. The second splitting valve 112 can then route the low pressure vapor to a compressor inlet 108 via a second splitter outlet 406.

As can be seen from the above with respect to FIGS. 4A and 4B, the second splitting valve 112 can include a second splitter inlet 402 that always receives the high pressure vapor from the compressor 106 (e.g., via the compressor outlet 110), and can include a second splitter outlet 406 that always routes the low pressure vapor to the compressor inlet 108. The remaining conduits (i.e., the first path 404A and the second path 404B) can switch based on the mode of the heat pump system 100. The switching of the valves can be completed by any number of reversing valve designs, including a solenoid valve and a reversing ball valve design. It is contemplated that the second splitting valve 112 includes a solenoid valve. In other words, since the second splitting valve 112 routes vaporized refrigerant, unlike the first splitting valve 124, the second splitting valve 112 does not suffer as high of a risk for leaking as the first splitting valve 124.

Figure 5B:
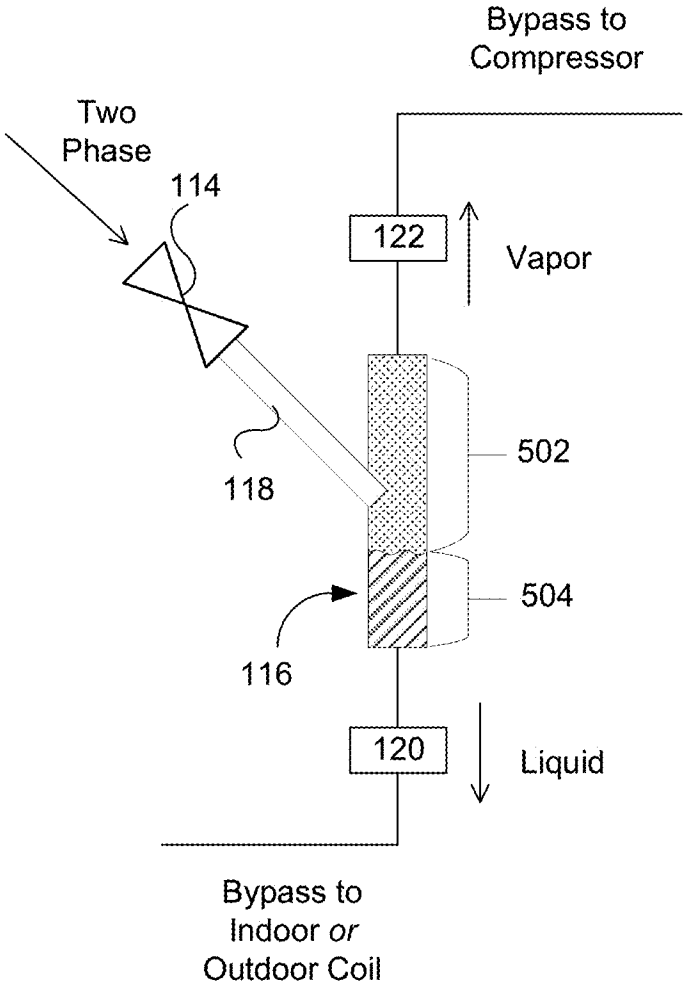
FIGS. 5A and 5B are schematics for an example gas bypass tank, in accordance with the present disclosure.
Figure 5A:
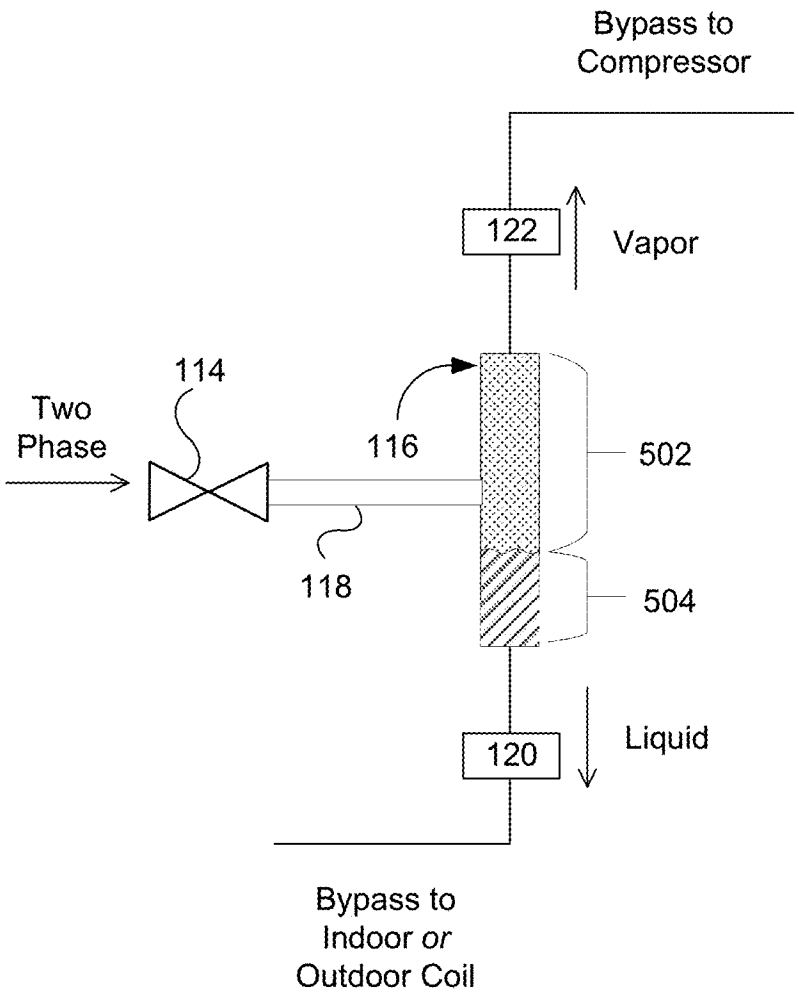

FIGS. 5A and 5B are schematics for an example gas bypass tank 116. The gas bypass tank 116 can include a bifurcating tank section that branches from the bypass inlet 118. As the two-phase fluid exiting the expansion valve 114 enters the bypass inlet 118, the gas bypass tank 116 can bifurcate into a vapor region 502 and a liquid region 504. Gravity can cause the denser liquid refrigerant of the two-phase fluid to sink to the liquid region 504 of the tank, while the vaporized refrigerant floats upwards to the vapor region 502. The liquid refrigerant can then exit the gas bypass tank 116 via the liquid outlet 120, where it is then bypassed to the first splitting valve 124. The vaporized refrigerant can exit the gas bypass tank 116 via the vapor outlet 122, where it is then bypassed to the compressor inlet 108.

The angle or inclination of the bypass inlet 118 can be adjusted according to desired phase-separation properties. For example, the bypass inlet 118 can be perpendicular with respect to the section of the tank defining the vapor region 502 and liquid region 504, as shown in FIG. 5A. In these examples, the separation of the liquid phase from the vapor phase can be facilitated by gravity at the connection between the bypass inlet 118 and the gas bypass tank 116. Alternatively, the bypass inlet 118 can be positioned at an angle with respect to the gas bypass tank 116, as shown in FIG. 5B. For example, the bypass inlet 118 can be positioned at a 45° angle, or any other inclined angle, such that the two-phase fluid enters the gas bypass tank 116 at trajectory directed toward the liquid region 504. This trajectory can cause the two-phase fluid to enter the gas bypass tank 116 with greater momentum than provided by a perpendicularly-positioned bypass inlet 118. The momentum created by the angled bypass inlet 118 can help facilitate the liquid-phase refrigerant to sink to the liquid region 504. In addition to providing momentum to the two-phase fluid, inclining the bypass inlet 118 can help to reduce splashing of the two-phase fluid at a splashing zone 602, which can further facilitate the separation of liquid from vapor. The splashing zone 602 is described in greater detail below with reference to FIGS. 6A-6E.

Figure 6A:
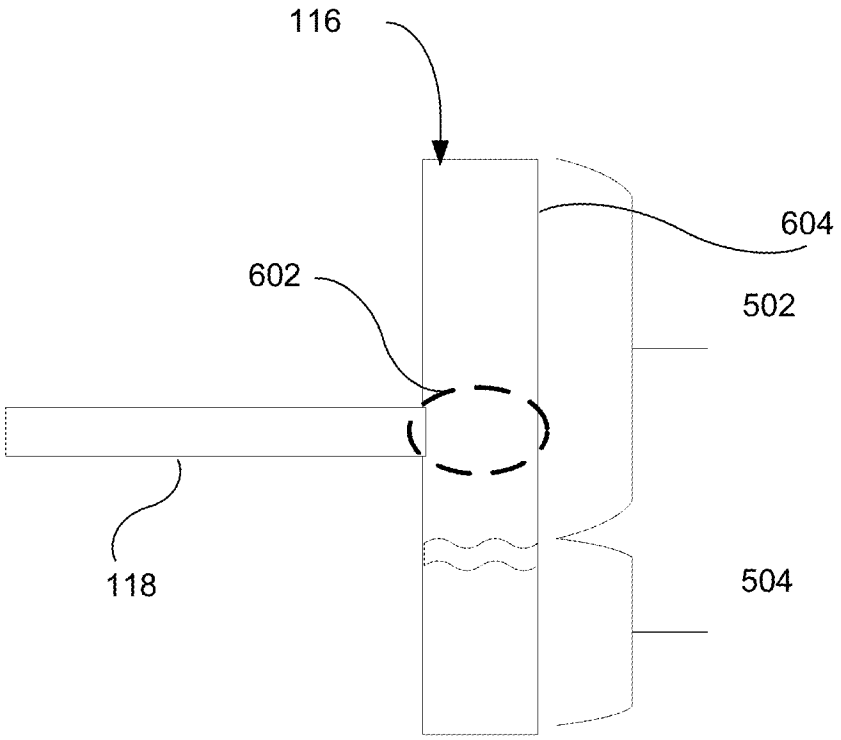
FIG. 6A-6E depict example gas bypass tanks, in accordance with the present disclosure.

FIG. 6A-6E depict example gas bypass tanks 116. As described above, one aim of the present systems and methods include ensuring proper separation of liquid refrigerant from vapor refrigerant, such that substantially all refrigerant entering an evaporator is in the liquid phase. One issue that may arise is splashing in a splashing zone 602 of the tank. FIG. 6A depicts the splashing zone 602 in the location of the connection between the bypass inlet 118 and gas bypass tank 116. As the two-phase fluid exits the bypass inlet 118 and enters the gas bypass tank 116, splashing can occur as the fluid hits the vertical wall 604 of the conduit opposite the bypass inlet 118. This splashing can cause larger droplets of liquid refrigerant to travel upward and exit the vapor outlet 122 of the gas bypass tank 116. This, of course, can cause a decrease in evaporator efficiency, as not all liquid is provided to the evaporator. One solution to this is to provide a degree of inclination to the bypass inlet 118, as described above. Another solution can include changing the cross sectional geometry 608 of the gas bypass tank 116.

Figure 6B:
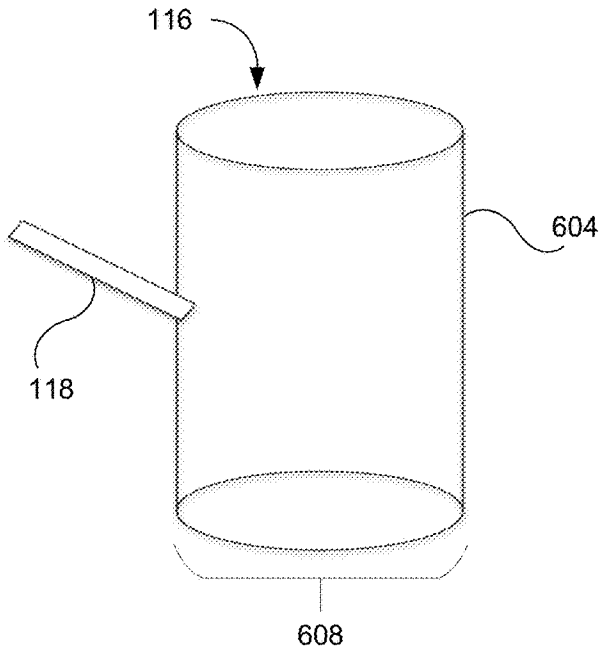
Figure 6D:
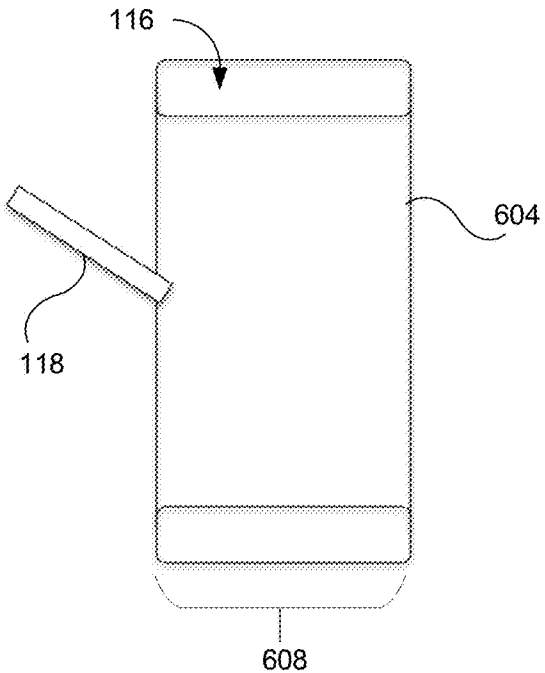
Figure 6C:
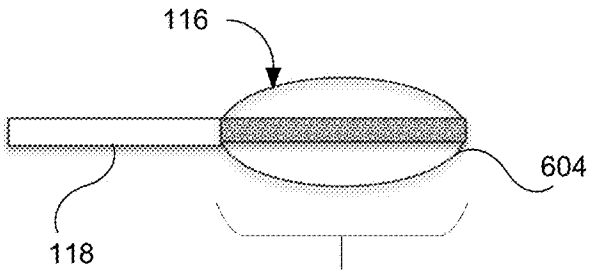
Figure 6E:
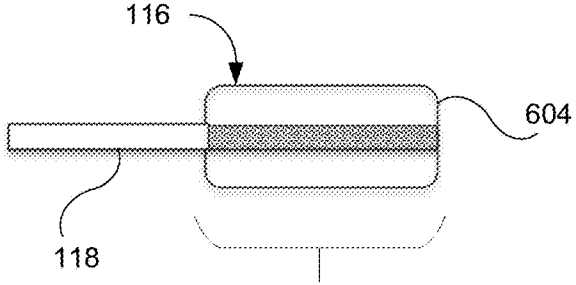

FIG. 6B-6E depict various cross sectional geometries 608 of gas bypass tanks 116 that can decrease the splash of the two-phase refrigerant as it enters the gas bypass tank 116. FIG. 6B is a front perspective view of a gas bypass tank 116 having an elliptical cross sectional geometry 608, and FIG. 6C is a top view of a gas bypass tank 116 having an elliptical cross sectional geometry 608. The elliptical cross sectional geometry 608 can enable more liquid to drop by gravity into the liquid region 504, while decreasing the amount of liquid that contacts the vertical wall 604, thereby reducing the splashing and providing better phase-separation. Additional non-circular cross sectional geometries 608 can also be employed to increase fluid separation. FIGS. 6D and 6E, for example, depict a rectangular cross sectional geometry 608. FIG. 6D is a front perspective view of a gas bypass tank 116 having a rectangular cross sectional geometry 608, and FIG. 6E is a top view of a gas bypass tank 116 having a rectangular cross sectional geometry 608. The rectangular construction also provides a means to decrease contact with the vertical wall 604 opposite the bypass inlet 118, while also ensuring adequate volume to receive the two-phase fluid received from the expansion valve 114.

Many of the processes described herein, such as switching the flow direction of the first splitting valve 124 or the second splitting valve 112, can be completed by a controller of the heat pump system 100. The controller can include one or more processors, which can receive signals (e.g., setting signals for heating/cooling mode, for example from a thermostat control) and output signals to the first splitting valve 124, the second splitting valve 112, the compressor 106, or any other component. The output signals can include instructions to complete the various processes and methods. The processor can include one or more of a microprocessor, microcontroller, digital signal processor, co-processor and/or the like or combinations thereof capable of executing stored instructions and operating upon data. The processor can constitute a single core or multiple core processor that executes parallel processes simultaneously. For example, the processor can be a single core processor that is configured with virtual processing technologies. The processor can use logical processors to simultaneously execute and control multiple processes.

The controller can include a memory. The memory can be in communication with the one or more processors. The memory can include instructions, for example a program or other application, that causes the processor and/or controller to complete any of the processes described herein. The memory can include, in some implementations, one or more suitable types of memory (e.g., volatile or non-volatile memory, random access memory (RAM), read only memory (ROM), programmable read-only memory (PROM), erasable programmable read-only memory (EPROM), electrically erasable programmable read-only memory (EEPROM), magnetic disks, optical disks, floppy disks, hard disks, removable cartridges, flash memory, a redundant array of independent disks (RAID), and the like), for storing files including an operating system, application programs, executable instructions and data.

Figure 7:
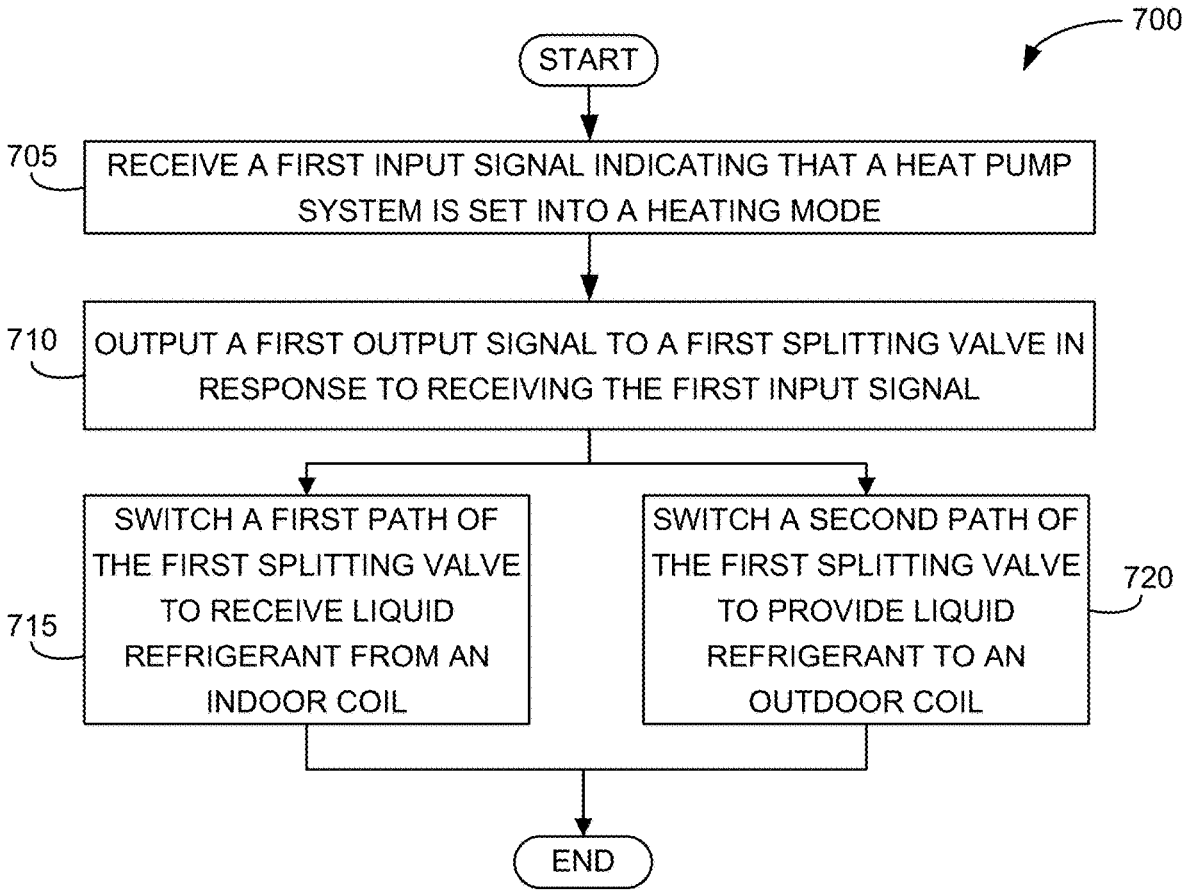
FIG. 7 is a flowchart showing an example process for a heat pump system in a heating mode, in accordance with the present disclosure.

FIG. 7 is a flowchart showing an example process 700 for a heat pump system set to heating mode, in accordance with the present disclosure. Again, the process 700 can be completed, for example, using a processor and memory storing instructions that, when executed, can perform the steps of process 700. Process 700 can begin at step 705, which can include receiving (e.g., at the controller) a first input signal indicating that a heat pump system is set into a heating mode. At step 710, process 700 can include outputting, via the controller, a first output signal to a first splitting valve (e.g., first splitting valve 124) in response to receiving the first input signal. The first output signal can include the instructions to switch switchable paths (e.g., the first plurality of switching paths 304) in order to operate the system in heating mode. At step 715, the first output signal can include instructions switch a first path (e.g., first path 304A) of the first splitting valve to receive liquid refrigerant from an indoor coil (e.g., indoor coil 104). At step 720, the first output signal can include instructions to switch a second path (e.g., second path 304B) of the first splitting valve to provide liquid refrigerant to an outdoor coil (e.g., outdoor coil 102). As described above, the first splitting valve in any of the examples can include a first splitter inlet configured to receive refrigerant from a gas bypass tank and/or can include a first splitter outlet configured to route refrigerant to the gas bypass tank.

Figure 8:
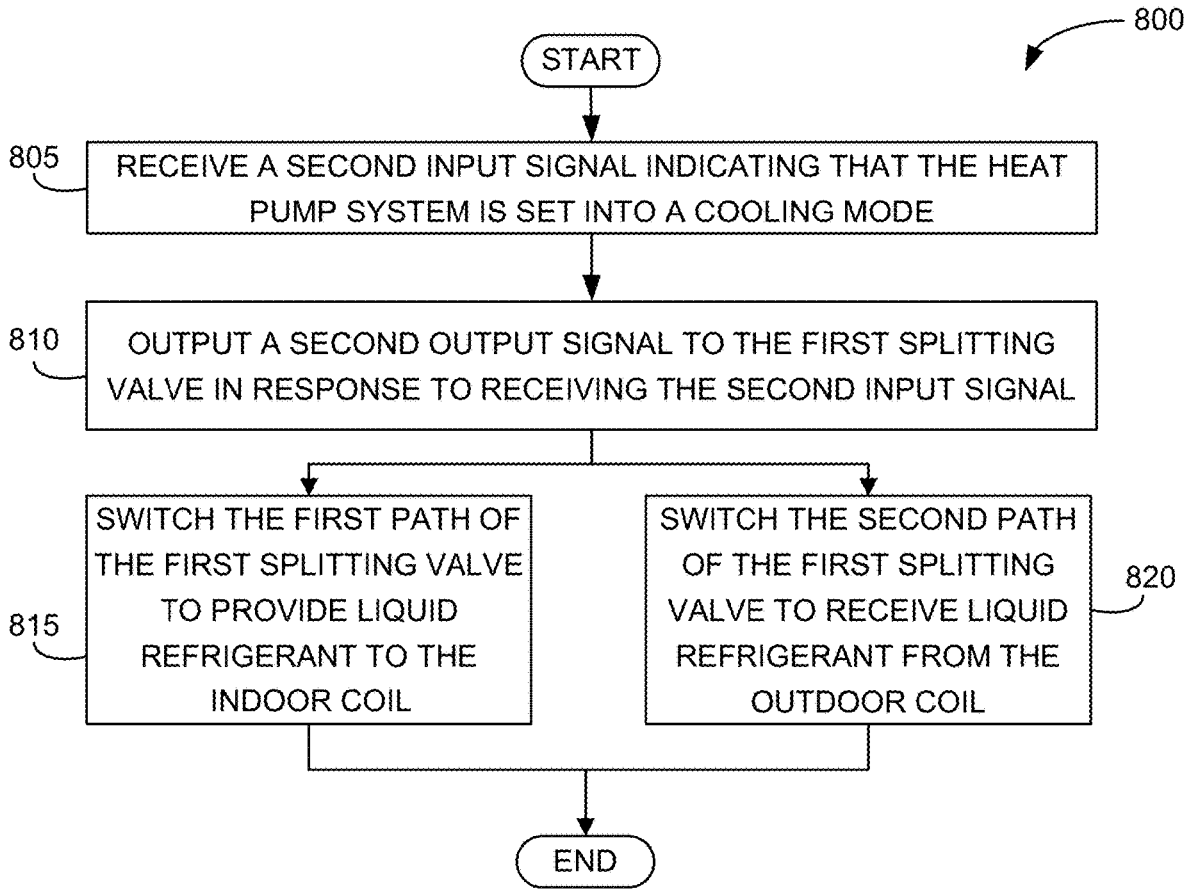
FIG. 8 is a flowchart showing an example process for a heat pump system in a cooling mode, in accordance with the present disclosure.

Process 700 can end after step 720. Additionally or alternatively, additional steps can be performed, such as those according to the examples described above. For example, the heat pump system of can be switched into a cooling mode. FIG. 8 is a flowchart showing an example process 800 for a heat pump system set to cooling mode. Again, the process 800 can be completed, for example, using a processor and memory storing instructions that, when executed, can perform the steps of process 800. Furthermore, process 800 can be performed by the same system described with reference to FIG. 7. Process 800 can begin at step 805, which can include receiving, at the controller, a second input signal indicating that the heat pump system is set into a cooling mode. At step 810, process 800 can include outputting, via the controller, a second output signal to the first splitting valve in response to receiving the second input signal. The second output signal can include the instructions to switch switchable paths in order to operate the system in cooling mode. At step 815, the second output signal can include instructions to switch a first path of the first splitting valve to provide liquid refrigerant to the indoor coil. At step 820, the second output signal can include instructions to switch the second path of the first splitting valve to receive liquid refrigerant from the outdoor coil.

Process 800 can end after step 820. Additionally or alternatively, additional steps can be performed, such as those according to the examples described above. For example, a second splitting valve (e.g., second splitting valve 112) can be used to route vaporized refrigerant between the indoor coils and the outdoor coils, as described above with reference to FIGS. 4A and 4B. The controller can output signals in order to switch as second plurality of switching valve in order to route the vaporized refrigerant according to the particular mode.

Certain examples and implementations of the disclosed technology are described above with reference to block and flow diagrams according to examples of the disclosed technology. It will be understood that one or more blocks of the block diagrams and flow diagrams, and combinations of blocks in the block diagrams and flow diagrams, respectively, can be implemented by computer-executable program instructions. Likewise, some blocks of the block diagrams and flow diagrams do not necessarily need to be performed in the order presented, can be repeated, or do not necessarily need to be performed at all, according to some examples or implementations of the disclosed technology. It is also to be understood that the mention of one or more method steps does not preclude the presence of additional method steps or intervening method steps between those steps expressly identified. Additionally, method steps from one process flow diagram or block diagram can be combined with method steps from another process diagram or block diagram. These combinations and/or modifications are contemplated herein.

It should also be noted that, as used in the specification and the appended claims, the singular forms "a," "an," and "the" include plural references unless the context clearly dictates otherwise. References to a composition containing "a" constituent is intended to include other constituents in addition to the one named.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

While the present disclosure has been described in connection with a plurality of exemplary aspects, as illustrated in the various figures and discussed above, it is understood that other similar aspects can be used, or modifications and additions can be made, to the described aspects for performing the same function of the present disclosure without deviating therefrom. For example, in various aspects of the disclosure, methods and compositions were described according to aspects of the presently disclosed subject matter. However, other equivalent methods or composition to these described aspects are also contemplated by the teachings herein. Therefore, the present disclosure should not be limited to any single aspect, but rather construed in breadth and scope in accordance with the appended claims.

The components described hereinafter as making up various elements of the disclosure are intended to be illustrative and not restrictive. Many suitable components that would perform the same or similar functions as the components described herein are intended to be embraced within the scope of the disclosure. Such other components not described herein can include, but are not limited to, for example, similar components that are developed after development of the presently disclosed subject matter. Additionally, the components described herein may apply to any other component within the disclosure. Merely discussing a feature or component in relation to one embodiment does not preclude the feature or component from being used or associated with another embodiment.

What is claimed is:

1. A heat pump system switchable between a heating mode and a cooling mode, the heat pump system comprising:

an outdoor coil operable as an evaporator when the heat pump system is in the heating mode and operable as a condenser when the heat pump system is in the cooling mode;

an indoor coil operable as the evaporator when the heat pump system is in the cooling mode and operable as the condenser when the heat pump system is in the heating mode;

a gas bypass tank comprising:

a bypass inlet in fluid communication with an expansion valve and configured to receive two-phase refrigerant from the expansion valve;

a liquid outlet; and a vapor outlet; and a first splitting valve comprising:

a first splitter inlet in fluid communication with the liquid outlet and configured to receive liquid refrigerant from the gas bypass tank; and a first plurality of switching paths configured to route the liquid refrigerant to one of the outdoor coil or the indoor coil, wherein the first splitting valve routes the liquid refrigerant to the indoor coil when the heat pump system is in the cooling mode, and wherein the first splitting valve routes the liquid refrigerant to the outdoor coil when the heat pump system is in the heating mode.

2. The heat pump system of claim 1, further comprising:

a compressor comprising:

a compressor inlet in fluid communication with the vapor outlet of the gas bypass tank; and a compressor outlet configured to provide vaporized refrigerant; and a second splitting valve comprising:

a second splitter inlet in communication with the compressor outlet; and a second plurality of switching paths configured to route the vaporized refrigerant to one of the outdoor coil or the indoor coil, wherein the vaporized refrigerant is routed by the second splitting valve to the outdoor coil when the heat pump system is in the cooling mode, and wherein the vaporized refrigerant is routed by the second splitting valve to the indoor coil when the heat pump system is in the heating mode.

3. The heat pump system of claim 2, wherein:

when the heat pump system is in the cooling mode, the second plurality of switching paths is further configured to route low pressure vapor from the indoor coil into the compressor inlet; and when the heat pump system is in the heating mode, the second plurality of switching paths is further configured to route low pressure vapor from the outdoor coil into the compressor inlet.

4. The heat pump system of claim 3, further comprising an equalization valve positioned between the compressor inlet and the vapor outlet of the gas bypass tank configured to equalize pressure between vaporized refrigerant in the vapor outlet and the low pressure vapor routed by the second plurality of switching paths.

5. The heat pump system of claim 2, wherein:

the first splitting valve is a rotating ball valve; and the second splitting valve is a solenoid valve.

6. The heat pump system of claim 1, wherein the gas bypass tank comprises an inlet conduit, a vapor region located within the gas bypass tank and at least partially above the inlet conduit, and a liquid region located within the gas bypass tank and at least partially below from the inlet conduit.

7. The heat pump system of claim 6, wherein the gas bypass tank comprises a non-circular cross section.

8. A heating and cooling system comprising:

a gas bypass tank comprising:

a bypass inlet configured to receive two-phase refrigerant from an expansion valve;

a liquid outlet; and a vapor outlet; and a first splitting valve comprising:

a first splitter outlet in fluid communication with the bypass inlet;

a first splitter inlet in fluid communication with the liquid outlet; and a first plurality of switching paths switchable from a first conduit path in fluid communication with a first coil system to a second conduit path in fluid communication with a second coil system.

9. The heating and cooling system of claim 8, wherein the first coil system is an outdoor coil and the second coil system is an indoor coil.

10. The heating and cooling system of claim 8, further comprising a compressor comprising:

a compressor inlet in fluid communication with the vapor outlet of the gas bypass tank; and a compressor outlet configured to provide vaporized refrigerant; and a second splitting valve comprising:

a second splitter inlet in communication with the compressor outlet; and a second plurality of switching paths configured to route the vaporized refrigerant to the first coiled system or the second coiled system.

11. The heating and cooling system of claim 10, wherein the first splitting valve is a rotating ball valve; and the second splitting valve is a solenoid valve.

12. The heating and cooling system of claim 10, wherein:

the first coil system is an outdoor coil and the second coil system is an indoor coil;

when the heating and cooling system is in a cooling mode, the second plurality of switching paths is further configured to route low pressure vapor from the indoor coil into the compressor inlet; and when the heating and cooling system is in a heating mode, the second plurality of switching paths is further configured to route low pressure vapor from the outdoor coil into the compressor inlet.

13. The heating and cooling system of claim 12, further comprising an equalization valve positioned between the compressor inlet and the vapor outlet of the gas bypass tank configured to equalize pressure between vaporized refrigerant in the vapor outlet and the low pressure vapor routed by the second plurality of switching paths.

14. The heating and cooling system of claim 8, wherein the gas bypass tank comprises a vapor region located within the gas bypass tank and at least partially above the bypass inlet, and a liquid region located within the gas bypass tank and at least partially below the bypass inlet.

15. The heating and cooling system of claim 14, wherein the gas bypass tank comprises a non-circular cross section.

16. The heating and cooling system of claim 8, further comprising an expansion valve disposed between the first splitting valve and the gas bypass tank and in fluid communication with the first splitter outlet at one end and the bypass inlet at another end.

* * * * *